United States Patent [19]

Sanders et al.

[11] Patent Number: 5,074,939

[45] Date of Patent: Dec. 24, 1991

[54] EXPLOSIVE COMPOSITION

[75] Inventors: Ross Sanders, Kalgoorlie; Robert Sheahan, Blackburn; Vladimir Sujansky, Burwood, all of Australia

[73] Assignee: ICI Australia Operations Proprietary Limited, Melbourne, Australia

[21] Appl. No.: 577,661

[22] Filed: Sep. 5, 1990

[30] Foreign Application Priority Data

Sep. 5, 1989 [AU] Australia ..... PJ6158

[51] Int. Cl.[5] ..... C06B 45/02

[52] U.S. Cl. ..... 149/21; 149/2; 149/46; 149/76; 149/77; 149/83

[58] Field of Search ..... 149/2, 46, 77, 21, 83, 149/76

[56] References Cited

U.S. PATENT DOCUMENTS 4,822,433 4/1989 Cooper et al. ..... 149/2

4,919,178 4/1990 Riga et al. ..... 149/2

*Primary Examiner*—Stephen J. Lechert, Jr.

*Attorney, Agent, or Firm*—Cushman, Darby & Cushman

[57] ABSTRACT

The present invention relates to cap-sensitive explosive compositions, in particular to emulsion explosives doped with solid particulate ammonium nitrate which retain stability and cap-sensitivity despite containing relatively high levels of dopant.

11 Claims, No Drawings

EXPLOSIVE COMPOSITION

It is well known in the art that the addition of ammonium nitrate in the form of prills to emulsion explosives provides an increase in bulk density and in explosive energy. Increasing the quantity of this cheap oxidizer results in a significant cost reduction. However, such doped emulsions are well known to exhibit dramatically reduced stability and sensitivity when compared to emulsions free of solid, particulate ammonium nitrate. The reduction in stability and sensitivity has severely limited the use of doped emulsions. Doped emulsions are used mostly in bulk operations where the charge is provided in relatively large diameters and typically detonated by primers containing large quantities of high explosives.

In Australian Patent Application No. 40006/85 there is disclosed an emulsion explosive composition containing a conductivity modifier. These compositions exhibit enhanced stability. While the addition of prilled ammonium nitrate to such compositions is possible, only relatively small amounts may be added before the sensitivity of the emulsion explosive composition is significantly reduced. Typically up to about 10% may be added without a significant reduction in sensitivity. The present invention relates to cap-sensitive explosive compositions.

We have now found an emulsion explosive composition in which solid particles of ammonium nitrate have been blended into a water-in-oil emulsion yet which explosive composition retains sensitivity and storage stability to a surprising degree. Solid, particulate ammonium nitrate can be added in amounts up to about 50% at which point the composition becomes unpumpable by conventional means and then is essentially a "dry mix" requiring the use of augers and the like to transport the composition. While small amounts of solid (up to about 10%), particulate ammonium nitrate have been added to water-in-oil emulsions without dramatic loss of stability or sensitivity it has been desirable, but not possible, to increase the amount of solid, particulate ammonium nitrate without dramatic-reduction of sensitivity and/or stability. Some compositions of the present invention exhibit heave energy in excess of expectations.

Compositions of the present invention are cap-sensitive. By cap-sensitive we mean that they are able to be detonated by conventional No. 8 electric detonators without the aid of high explosive primers A No. 8 electric detonator comprises 160 mg of priming composition and 450 mg of base charge.

Accordingly, we provide, a cap-sensitive explosive composition consisting essentially of a water-in-oil emulsion explosive and from 20 to 40% by weight of the explosive composition of solid, particulate ammonium nitrate wherein said water-in-oil emulsion explosive comprises a discontinuous oxygen-releasing salt phase, a continuous water-immiscible organic phase comprising an organic fuel, an emulsifier component comprising at least one emulsifier comprising a lipophilic moiety and an hydrophilic moiety wherein said lipophilic moiety is a saturated or unsaturated carbon chain containing from 40 to 500 carbon atoms, and void-containing material wherein the discontinuous oxygen-releasing salt phase comprises a perchlorate selected from the group consisting of ammonium perchlorate, sodium perchlorate and mixtures thereof.

The solid particulate ammonium nitrate for use in the present invention may be in the form of prilled, crushed, granular or any other convenient form of solid particulate ammonium nitrate or mixtures thereof.

The solid particulate ammonium nitrate may contain additional components such as further oxygen-releasing salts or compounds added to the solid particulate ammonium nitrate to modify the physical characteristics of the particles. For example, the use of modifiers such as the salts of iron and aluminum in ammonium nitrate compositions is known in the art. The presence of such modifiers in compositions of prilled ammonium nitrate has the significant advantage of enhancing mechanical strength of the prills giving the composition a high resistance both to prill breakdown during handling and to caking on storage. Examples of ammonium nitrate compositions comprising modifiers such as oxides, sulfates or hydroxides of iron and aluminium are described in Australian Patent Numbers 436409 and 484229 and U.S. Pat. No. 4,268,490 together with methods for their preparation.

We have found it particularly convenient to use ANFO as a source of solid particulate ammonium nitrate. ANFO, an ammonium nitrate-fuel oil blend well known in the art, is usually oxygen-balanced and therefore water-in-oil emulsion explosives which are themselves substantially oxygen-balanced may be used as the water-in-oil emulsion explosive. This is particularly convenient. While it is not essential that the explosive composition of the present invention be oxygen-balanced, it is preferred. Oxygen-balanced compositions (or compositions slightly oxygen- negative) provide the most efficient use of the fuel and thus the most complete reaction of all components. When using solid particulate ammonium nitrate which is not in an oxygen-balanced form, it may be preferable to add additional fuel to the water-immiscible organic phase of the water-in-oil emulsion thereby providing an essentially oxygen-balanced explosive composition.

The solid particulate ammonium nitrate is present in an amount in the range of 20 to 40% by weight of the explosive composition. It is preferred that the solid particulate ammonium nitrate be present in the range of 25 to 40%. It is most preferred that the solid particulate ammonium nitrate be present at about 30% by weight of the explosive composition.

The water-in-oil emulsion explosive may be present in the explosive composition in the range of 80 to 60% by weight, preferably in the range 75 to 60% and most preferably 70% by weight of the explosive composition.

Suitable oxygen-releasing salts for use in the discontinuous oxygen-releasing salt phase of the water-in-oil emulsion explosive include the alkali and alkaline earth metal nitrates and chlorates, ammonium nitrate, ammonium chlorate, and mixtures thereof. The preferred oxygen-releasing salts include ammonium nitrate, sodium nitrate and calcium nitrate. More preferably, the oxygen-releasing salt comprises ammonium nitrate or a mixture of ammonium nitrate and sodium or calcium nitrates.

Typically, the oxygen-releasing salt comprises from 45 to 95% and preferably from 60 to 90% by weight of the water-in-oil emulsion explosive component of the explosive composition.

The perchlorate for use in the discontinuous oxygen-releasing salt phase of the water-in-oil emulsion explosive is preferably sodium perchlorate. Ammonium perchlorate is more difficult to handle safely. It is preferred that the perchlorate be present in an amount in the range 3 to 15% by weight of the discontinuous oxygen-releasing salt phase.

The amount of water employed in the discontinuous oxygen-releasing salt phase of the water-in-oil emulsion explosive is preferably in the range of 0% to 12% by weight of the total composition. More preferably the water content of the composition of the present invention is in the range of 3% to 7%.

The organic fuel component of the explosive composition of the present invention may include aliphatic, alicyclic and aromatic compounds and mixtures thereof which are in the liquid state at the formulation temperature. Suitable organic fuels may be chosen from fuel oil, diesel oil, distillate, kerosene, naphtha, waxes, (e.g. microcrystalline wax, paraffin wax and slack wax), paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are paraffin oils, especially when combined with waxes such as microcrystalline wax.

Typically, the organic fuel of the continuous phase of the emulsion explosive component comprises from 2 to 15% by weight and preferably 3 to 10% by weight of the emulsion explosive component of the explosive composition.

The emulsifying agent for use in the explosive composition of the present invention comprises a lipophilic moiety and an hydrophilic moiety wherein said lipophilic moiety is a saturated or unsaturated hydrocarbon chain containing from 40 to 500 carbon atoms. It is preferred that the lipophilic portion be derived from a polymer of a mono-olefin. Suitable polyolefins include those derived from olefins containing from 2 to 6 carbon atoms, in particular ethylene, propylene, butene-1 and isoprene, but especially isobutylene.

The hydrophilic moiety is polar in character and suitably comprises an organic residue having a molecular weight not exceeding 450, preferably not exceeding 300 and particularly preferably not exceeding 200. In determining the aforementioned molecular weights, any contribution from an ionic moiety, optionally introduced as hereinafter described, is to be disregarded. The organic residue is desirably monomeric, although oligomeric groupings—containing, for example, not more than about 10 repeat units—may be employed, provided the molecular weight thereof is within the aforementioned limit. Suitable monomeric groupings may be derived from polyols such as glycerol, pentaerythritol, and sorbitol or an internal anhydride thereof (e.g. sorbitan); from amines such as ethylene diamine, diethylene triamine and dimethylaminopropylamine; from amides such as 2-hydroxypropanolamide; from alkanolamines such as ethanolamine or diethanolamine; and from heterocyclics such as oxazoline or imidazoline. Suitable oligomeric groupings include short-chain poly(oxyethylene) groups (i.e. those containing up to 10 ethylene oxide units).

The lipophilic moiety and the hydrophilic moiety may be joined through a joining moiety or may be joined directly. We have found it preferable that the joining moiety be succinic acid or anhydride. Conveniently the lipophilic moiety and the joining moiety may be provided by a poly[alk(en)yl] succinic acid or anhydride. These are commercially-available materials which are made by an addition reaction at an elevated temperature between a polyolefin containing a terminal unsaturated group and maleic anhydride, optionally in the presence of a halogen catalyst.

We have found it preferable that the emulsifier be of a type described in Australian Patent Application No. 40006/85 (Cooper & Baker). The emulsifiers are electrical conductivity modifiers which are present in an amount effective to provide a water-in-oil emulsion which, in the absence of a supplementary adjuvant, exhibits an electrical conductivity, measured at a temperature of 6° C., not exceeding 60,000 picomhos/meter.

Other emulsifiers which are particularly preferred include those described in our copending Australian Patent Applications Nos. 60817/86, 29932/89 and 29933/89.

Further emulsifiers may be blended into the emulsifier component. In fact, it may be preferred to add a second emulsifier. The second emulsifier may be any conventional water-in-oil emulsifier in an amount and of an HLB value sufficient to provide the emulsifier blend with an HLB in the range of from 1.4 to 3.0. HLB values of conventional emulsifiers are known in the art and may be found in literature relating to emulsifiers and detergents, for example McCutcheon's books on "Emulsifiers and Detergents".

Examples of conventional water-in-oil emulsifiers include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof Among the preferred emulsifiers agents are the 2-alkyl- and 2-alkenyl-4,4'-bis (hydroxymethyl) oxazoline, the fatty acid esters of sorbitol, lecithin, copolymers of poly(oxyalkylene) glycols and poly(12-hydroxystearic acid), and mixtures thereof, and particularly sorbitan monooleate, sorbitan sesquioleate, 2-oleyl- 4,440 -bis (hydroxymethyl) oxazoline, mixture of sorbitan sesquioleate, lecithin and a copolymer of poly (oxyalkylene) glycol and poly (12-hydroxystearic acid), and mixtures thereof.

Particularly preferred second emulsifier components include sorbitan esters such as those selected from the group consisting of sorbitan monooleate, sorbitan trioleate, sorbitan sesquioleate, sorbitan tallate and sorbitan laurate.

The emulsifier component blend is typically present in the range 0.2 to 10% by weight of the water-in-oil emulsion. Preferably up to 5% may be used, however, higher proportions of the blend of emulsifiers may be used and may serve as a supplemental fuel for the composition, but in general it is not necessary to add more than 5% by weight of the emulsifier blend to achieve the desired emulsifying effect.

Void-containing material is incorporated in emulsion explosives to sensitize the emulsions and render them more easily detonable. The incorporation of void-containing material however reduces the bulk strength of the composition. Explosive compositions of the present invention have the advantage that adequate sensitivity can be obtained in compositions with relatively low voidage and high bulk strength.

Typically, void-containing material to be incorporated into the compositions of the present invention is in the form of fine gas bubbles dispersed throughout the water-in-oil emulsion component of the explosive composition, hollow particles, porous particles or combinations thereof. Fine gas bubbles may be dispersed throughout the water-in-oil emulsion component by any convenient means such as by mechanical agitation, injection or bubbling gas through the composition, or by in situ generation of the gas by chemical means. Suitable chemicals for the in situ generation of gas bubbles include peroxides such as hydrogen peroxide, nitrites such as sodium nitrite, nitrosoamines such as N,N'dinitrosopenta- methylenetetramine, alkali metal borohydrides such as sodium borohydride, and carbonates such as sodium carbonate. Preferred chemicals for the in situ generation of gas bubbles are nitrous acid and its salts which decompose under conditions of acid pH to produce gas bubbles. Thiourea and/or thiocyanate ions may be used to accelerate the decomposition of a nitrite gassing agent. Examples of suitable hollow particles include small hollow microspheres of glass and resinous materials such as phenol- formaldehyde resins, poly(-vinylidenechloride)/poly (acrylonitrile) copolymers and urea-formaldehyde resins. Examples of suitable porous materials include expanded minerals such as perlite.

Conveniently the void-containing material comprises gas of bubble diameter below 200 um, preferably below 100 um, more preferably between 20 and 90 um and particularly preferably between 40 and 70 um.

The addition of void-containing material allows the density of the explosive composition to be controlled. It is desirable to add the least possible amount of void-containing material to the explosive composition while providing a sufficiently sensitized composition. We have found that compositions of the present invention may be cap-sensitive in 100 mm diameter charges at densities of less than 1.28 g $cm^{-3}$ and even up to 1.35 g $cm^{-3}$ and in 20 mm diameter charges at densities of less than 1.22 $gm^{-3}$ and even up to 1.26 g $cm^{-3}$. In the context of the present invention it is preferred that explosive compositions have densities of 1.2 $gm^{-3}$ or greater.

If desired, other optional fuel materials, hereinafter referred to as secondary fuels, may be incorporated into the water-in-oil emulsion component of the compositions of the present invention in addition to the water-immiscible organic fuel phase. Examples of such secondary fuels include finely-divided solids, and water-miscible organic liquids which can be used to partially replace water as a solvent for the oxygen-releasing salts or to extend the aqueous solvent for the oxygen-releasing salts. Examples of solid secondary fuels include finely divided materials such as : sulfur, aluminium, and carbonaceous materials such as gilsonite, comminuted coke or charcoal, carbon black, resin acids such as abietic acid, sugars such as glucose or dextrose and other vegetable products such as starch, nut meals, grain meal and wood pulp. Examples of water-miscible organic liquids include alcohols such as methanol, glycols such as ethylene glycol, amides such as formamide and amines such as methylamine.

Typically, the optional secondary fuel component of the compositions of the present invention comprise from 0 to 30% by weight of the water-in-oil emulsion component.

The explosive composition of the present invention exhibits a surprising degree of sensitivity and stability considering the relatively high levels of solid, particulate ammonium nitrate present in the compositions.

Water-in-oil emulsion explosives have been added to ANFO (Ammonium Nitrate particles coated in Fuel Oil) in an attempt to waterproof the ANFO; however such compositions were unable to be reliably detonated. Australian Patent Application No. 38977/78 demonstrated that solid ammonium nitrate/water-in-oil emulsion blends containing 60 to 90% "solid undissolved particulate oxidizer" could be detonated; however, such "dry mix" compositions are relatively insensitive to detonation and required boosters to ensure complete detonation.

Australian Patent Application No. 50011/79 disclosed a blasting agent consisting of a blend of solid particulate oxidizer and water-in-oil emulsion which blend comprises of 40 to 60% of solid particulate oxidizer. These blasting agents are not particularly sensitive to detonation and, in some instances, are less sensitive than conventional ANFO.

Compositions of the present invention are cap-sensitive. Indeed some compositions of the present invention are so sensitive to blasting cap detonation that they can be reliably detonated with No. 2 electric blasting caps.

Surprisingly, the feature of cap-sensitivity is exhibited in exceptionally small diameter charges. We have found that compositions of the present invention many typically retain cap-sensitivity in diameters as small as 25 mm.

Some compositions of the present invention exhibit heave energy in excess of expectations. The detonation of explosives compositions releases energy in the form of fragmentation energy and heave energy. Fragmentation energy (often referred to as shock energy) determines the ability of the explosive composition to shatter the surrounding media. Blasting hard media, such as rock, requires explosive compositions with relatively high fragmentation energies. Heave energy (often referred to as bubble energy) determines the ability of the explosive composition to move its surrounds. When blasting soft media, such as overburden or coal, the use of explosive compositions with relatively high heave energies is preferred.

Dynamites have provided users of industrial explosives with an explosive whose balance of fragmentation energy and heave energy could be readily controlled. Over recent years dynamites have been able to be replaced in applications requiring relatively high fragmentation energies with ammonium nitrate/water-based blasting agents which are cheaper and safer and which offer better storage stability.

Dynamites, however, still find applications where relatively high heave energies are required. The factors that lead to the replacement of dynamites in relatively high fragmentation energy applications (cost, safety and storage stability) remain problems in the relatively high heave energy applications.

The compositions of this invention allow performance similar to dynamites to be realised without exhibiting excessive impact and friction sensitivity hazards of nitroglycerine based explosives. In this aspect of the invention the safety of the present compositions is significantly improved over the conventional dynamites.

It will be understood that by the term "fudge point" we mean the temperature of the onset of crystallization.

At step (b) in the process hereinafter described "rapid mixing" will be understood to be mixing of sufficient vigour to form an emulsion and may be readily determined by the skilled person without undue experimentation.

In a further embodiment of the invention, we provide a process for preparing an explosive composition, the process comprising the steps of:

(a) forming an aqueous oxidizer phase comprising dissolving the oxygen-releasing salt component and the perchlorate component in water at a temperature above the fudge point of the salt solution;

(b) combining, with rapid mixing, the organic phase, emulsifying agent and said aqueous salt solution;

(c) mixing until the emulsion is uniform;

(d) mixing into said emulsion a discontinuous gaseous component; and (e) mixing into the emulsion thus formed the solid particulate ammonium nitrate and optionally any other solid ingredients.

We have found it particularly preferable that the emulsion formed at (c) be mixed until the viscosity, measured on a Brookfield Viscometer with a TF spindle at 5 rpm, is about 200,000 cps prior to the mixing into the emulsion any "dry" material. By the term "dry material" it will be understood that it is meant the solid particulate ammonium nitrate, any solid material containing voids or any other solid ingredients.

The invention is now illustrated by, but is not limited to, the following examples in which all parts and percentages are expressed on a weight basis unless specifically stated otherwise.

EXAMPLE 1

An explosive composition was prepared using the following components.

| COMPONENT | PART W/W (%) |
|---|---|
| Discontinuous oxygen-releasing salt phase | |
| Chemically Pure Ammonium Nitrate | 48.31 |
| Sodium Perchlorate | 6.24 |
| Water | 5.46 |
| Continuous water-immiscible organic phase | |
| Microcrystalline wax | 0.73 |
| Paraffin wax | 0.92 |
| Paraffin oil | 0.64 |
| Emulsifier* | 0.80 |
| Additional components added to emulsion | |
| Aluminium** | 3.96 |
| Microspheres*** | 2.94 |
| Solid Particulate Ammonium Nitrate | |
| Prilled Ammonium Nitrate**** | 28.20 |
| Paraffin Oil | 1.80 |

*Emulsifier: a condensate of monoethanolamine and polyisobutylene succinic anhydride.
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

The chemically pure ammonium nitrate and the sodium perchlorate were dissolved in water at a temperature of 9° C. and the solution was added to a stirred mixture of microcrystalline wax, paraffin wax and emulsifier in a Hobart N-50 mixer. Stirring was continued and an emulsion of even consistency was formed.

The aluminium and the microspheres were then blended into the emulsion using the Hobart N-50 mixer with a paddle attachment.

The prilled ammonium nitrate was combined with the paraffin oil to form an ANFO composition (94% prilled ammonium nitrate, 6% paraffin oil). This ANFO composition was then blended into emulsion so as to form an essentially uniform emulsion. The density of the so-formed explosive composition was 1.22 g $cm^{-3}$.

The explosive composition thus formed was then subjected to firing tests and results are shown in Table I below.

EXAMPLE 2

An explosive composition was prepared using the following components according to the process of Example 1.

| COMPONENT | PART W/W (%) |
|---|---|
| Discontinuous oxygen-releasing salt phase | |
| Chemically Pure Ammonium Nitrate | 48.31 |
| Sodium Perchlorate | 6.24 |
| Water | 5.46 |
| Continuous water-immiscible organic phase | |
| Microcrystalline wax | 0.73 |
| Paraffin wax | 0.92 |
| Paraffin oil | 2.44 |
| Emulsifier* | 0.80 |
| Additional components added to emulsion | |
| Aluminium** | 3.96 |
| Microspheres*** | 2.94 |
| Solid Particulate Ammonium Nitrate | |
| Prilled Ammonium Nitrate**** | 28.20 |

*Emulsifier: a condensate of monoethanolamine and polyisobutylene succinic anhydride.
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

The density and firing results are shown at Table I below.

COMPARATIVE EXAMPLE A

An explosive composition was prepared using the following components according to the process of Example 1.

| COMPONENT | PART W/W (%) |
|---|---|
| Discontinuous oxygen-releasing salt phase | |
| Chemically Pure Ammonium Nitrate | 51.74 |
| Sodium Perchlorate | 6.68 |
| Water | 5.85 |
| Continuous water-immiscible organic phase | |
| Microcrystalline wax | 0.78 |
| Paraffin wax | 1.00 |
| Emulsifier* | 1.55 |
| Additional components added to emulsion | |
| Aluminium** | 4.25 |
| Microspheres*** | 3.15 |
| Solid Particulate Ammonium Nitrate | |
| Prilled Ammonium Nitrate**** | 23.50 |
| Paraffin Oil | 1.50 |

*Emulsifier: Sorbitan Monooleate
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

The density and firing results are shown at Table I below.

COMPARATIVE EXAMPLE B

An explosive composition was prepared using the following components according to the process of Example 1.

| COMPONENT | PART W/W (%) |
|---|---|
| Discontinuous oxygen-releasing salt phase | |
| Chemically Pure Ammonium Nitrate | 34.49 |
| Sodium Perchlorate | 4.45 |
| Water | 3.90 |
| Continuous water-immiscible organic phase | |
| Microcrystalline wax | 0.52 |
| Paraffin wax | 0.65 |
| Emulsifier* | 1.05 |
| Additional components added to emulsion | |
| Aluminium** | 2.84 |
| Microspheres*** | 2.10 |
| Solid Particulate Ammonium Nitrate | |
| Prilled Ammonium Nitrate**** | 47.00 |
| Paraffin Oil | 3.00 |

*Emulsifier: Sorbitan Monooleate
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

The density and firing results are shown at Table I below.

EXAMPLE 3

An explosive composition was prepared using the following components.

| COMPONENT | PART W/W (%) |
|---|---|
| Discontinuous oxygen-releasing salt phase | |
| Chemically Pure Ammonium Nitrate | 48.31 |
| Sodium Perchlorate | 6.24 |
| Water | 5.46 |
| Continuous water-immiscible organic phase | |
| Microcrystalline wax | 0.73 |
| Paraffin wax | 0.92 |
| Paraffin oil | 0.64 |
| Emulsifier* | 0.80 |
| Additional components added to emulsion | |
| Aluminium** | 3.96 |
| Microspheres*** | 2.94 |
| Solid Particulate Ammonium Nitrate | |
| Prilled Ammonium Nitrate**** | 28.20 |
| Paraffin Oil | 1.80 |

*Emulsifier: a condensate of diethanolamine
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

EXAMPLE 4

A primary emulsion was made as described in Example 1. To 65.49% w/w of the primary emulsions 4.12% w/w aluminium and 0.39% w/w 551 DE 80 'EXPANCEL' plastic microspheres were blended in by hand in a fumecupboard until the balloons were covered with emulsion. Mixing was completed using an A120 Hobart planetary mixer at low speed.

The prilled ammonium nitrate was combined with paraffin oil, as in Example 1. This ANFO composition was then blended into the emulsion so as to form an essentially uniform composition.

The composition had a density of 1.23 g/cc, it fired with a No. 3 testing detonator with a VOD of 4.33 km/sec in 32 mm diameter. The emulsion composition showed no signs of deterioration by crystallisation after three months storage.

COMPARATIVE EXAMPLE C

An explosive composition was prepared using the following components according to the procedure of Example 1.

| COMPONENT | PART W/W (%) |
|---|---|
| Discontinuous oxygen-releasing salt phase | |
| Chemically Pure Ammonium Nitrate | 69.61 |
| Sodium Perchlorate | 8.98 |
| Water | 7.87 |
| Continuous water-immiscible organic phase | |
| Microcrystalline wax | 1.05 |
| Paraffin wax | 1.33 |
| Paraffin oil | 0.64 |
| Emulsifier* | 0.80 |
| Additional components added to emulsion | |
| Aluminium** | 5.67 |
| Microspheres*** | 3.40 |

*Emulsifier: a condensate of monoethanolamine and polyisobutylene succinic anhydride.
**Aluminium: Comalco - 200 mesh aluminium
***Microspheres: Q Cell 523 FE microballoons supplied by P.Q Australia.
****Prilled Ammonium Nitrate: NITROPRIL (Trade Mark) Explosive grade from ICI Australia Operations Pty Ltd.

The density and firing results are shown at Table I below.

TABLE I

| | | Minimum Initiation Tests | | | | | | |
|---|---|---|---|---|---|---|---|---|
| | | Ambient Storage Period | | | | Charge Diameter | Density | VOD |
| Example | Initial | 40 days | 6 mth | 12 mth | 18 mth | (mm) | (g/cm³) | (km/s) |
| 1 | P. No. 2 | | | | P. No. 6 | 25 | 1.22 | 3.98 |
| | | | | | | 32 | 1.22 | 4.24 |
| 2 | P. No. 2 | | | | | 25 | 1.16 | 3.86 |
| | | | | | | 32 | 1.16 | 4.03 |
| CEA | P. No. 4 | P. No. 8 | FTI | | | 32 | 1.31 | 3.75 |
| CEB | FTI | | | | | 32 | | FTI |
| 3 | | | | | | | | |
| 4 | P. No. 3 | | * | | | 32 | 1.23 | 4.33 |
| CEC | P. No. 2 | | P. No. 2 | P. No. 3 | P. No. 6 | 25 | 1.23 | |
| | | | | | | 32 | 1.23 | 4.71 |

FTI = Failed to initiate with a No. 8 electric detonator
* = Not yet tested but appears visually good after 3 mths storage.

EXAMPLES 5 AND 6 AND COMPARATIVE EXAMPLE D

An explosive composition was prepared using the following components.

| COMPONENT | PART W/W (%) |
|---|---|
| Discontinuous oxygen-releasing salt phase | |
| Chemically Pure Ammonium Nitrate | 68.0 |
| Sodium Perchlorate | 8.8 |
| Water | 7.7 |
| Continuous water-immiscible organic phase | |
| Microcrystalline wax | 0.84 |
| Paraffin wax | 0.84 |
| Paraffin oil | 1.69 |
| Emulsifier* | 1.50 |
| Additional components added to emulsion | |
| Aluminium** | 5.9 |
| Microspheres*** | 5.0 |

A 300 kg batch of emulsin explosive was produced by the following procedure.

13.9 kg of hot oil phase (87° C.) was added to blender and 257 kg of oxidiser solution added while mixing on fast speed. Mixing was continued for 2 mins. once all oxidiser solution had been added. Aluminium and microballoons were added and mixed in for one minute on fast speed.

This emulsion explosive was then doped with various levels of ANFO (94% Nitropril, 6% Paraffin Oil).

| 10% ANFO - Comparative Example D<br>20% ANFO - Example 5<br>30% ANFO - Example 6 | | | |
|---|---|---|---|
| Example | Density ($g\ cm^{-3}$) | Minimum Initiator | Velocity of Detonation |
| CED | 1.21 | No. 3 | 4.3 |
| 5 | 1.21 | No. 6 | 4.1 |
| 6 | 1.22 | No. 8 | 4.0 |

The claims defining the invention are as follows:

We claim:

1. A cap-sensitive explosive composition consisting essentially of a water-in-oil emulsion explosive and from 20 to 40% by weight of the explosive composition of solid, particulate ammonium nitrate wherein said water-in-oil emulsion explosive comprises a discontinuous oxygen-releasing salt phase, a continuous water-immiscible organic phase comprising an organic fuel, an emulsifier component comprising at least one emulsifier comprising a lipophilic moiety and an hydrophilic moiety wherein said lipophilic moiety is a saturated or unsaturated carbon chain containing from 40 to 500 carbon atoms, and void-containing material wherein the discontinuous oxygen-releasing salt phase consists essentially of a) water in an amount of from 0 to 12% by weight b) an emulsion explosive component and c) a perchlorate selected from the group consisting of ammonium perchlorate, sodium perchlorate and mixtures thereof.

2. A cap-sensitive explosive composition according to claim 1 wherein the water content of the discontinuous phase of the water-in-oil emulsion is in the range 3 to 7% by weight of the explosive composition.

3. A cap-sensitive explosive composition according to claim 1 wherein the density of the explosive composition is greater than 1.2%.

4. A cap-sensitive explosive composition according to claim 1 wherein the solid, particulate ammonium nitrate is in the form of an ammonium nitrate/fuel oil blend.

5. A cap-sensitive explosive composition according to claim 1 wherein the ammonium nitrate/fuel oil blend contains 94% ammonium nitrate and 6% fuel oil.

6. A cap-sensitive explosive composition according to claim 1 wherein the solid, particulate ammonium nitrate is present in the range of 25 to 40% by weight of the explosive composition.

7. A cap-sensitive explosive composition according to claim 1 wherein the solid, particulate ammonium nitrate is present at 30% by weight of the explosive composition.

8. A cap-sensitive explosive composition according to claim 1 wherein the perchlorate is sodium perchlorate.

9. A cap-sensitive explosive composition according to claim 1 wherein the perchlorate is present in an amount in the range of 3 to 15% by weight of the discontinuous oxygen-releasing salt phase.

10. A cap-sensitive explosive composition according to claim 1 wherein the organic fuel is selected from the group consisting of paraffin oil and paraffin oil combined with microcrystalline wax.

11. A cap-sensitive explosive composition according to claim 1 wherein the emulsifier exhibits an electrical conductivity, measured at a temperature of 6° C., not exceeding 60,000 picomhos/meter.

* * * * *